US006749319B1

(12) United States Patent
Muse

(10) Patent No.: US 6,749,319 B1
(45) Date of Patent: Jun. 15, 2004

(54) SMART LIGHT

(76) Inventor: Scott William Muse, 13656 Wildflower La., Clifton, VA (US) 20124

( * ) Notice: Subject to any disclaimer, the term of this patent is extended or adjusted under 35 U.S.C. 154(b) by 41 days.

(21) Appl. No.: 10/176,062

(22) Filed: Jun. 21, 2002

(51) Int. Cl.[7] ..... F21V 33/00
(52) U.S. Cl. ..... 362/154; 362/802
(58) Field of Search ..... 362/154, 155, 362/156, 127, 133, 277, 802, 276

(56) References Cited

U.S. PATENT DOCUMENTS 2,411,100 A 11/1946 MacDonald
4,754,376 A * 6/1988 Winslow ..... 362/92
5,032,957 A 7/1991 Canfield ..... 362/133
5,558,429 A * 9/1996 Cain ..... 362/155
6,102,548 A * 8/2000 Mantle et al. ..... 362/155

* cited by examiner

*Primary Examiner*—Laura K. Tso
(74) *Attorney, Agent, or Firm*—Patent & Trademark Services, Inc.; Joseph H. McGlynn

(57) ABSTRACT

A container having a light operatively connected to a motion detector. The motion detector is attached to the lid of the container and a light is attached to the inside of the container. When motion detector detects movement, the light will automatically turn on.

4 Claims, 3 Drawing Sheets

SMART LIGHT

BACKGROUND OF THE INVENTION

This invention relates, in general, to an improved illuminating device and, in particular, to an improved illuminating device having a motion detector.

DESCRIPTION OF THE PRIOR ART

In the prior art various types of illuminating devices have been proposed. For example, U.S. Pat. No. 4,754,367 to Winslow discloses an automatic illuminating device for an ice chest that is activated by a position sensing switch.

U.S. Pat. No. 2,411,100 to Macdonald discloses an illuminating device for a closet that is activated by a plunger switch.

U.S. Pat. No. 5,032,957 to Canfield discloses an automatic illuminating device for a cabinet, which is operated by a plunger switch activated by the door of the cabinet.

U.S. Design Pat. No. 376,555 to Gebhart discloses a design for a deer antler

U.S. Pat. No. 5,558,429 to Cain discloses a portable illuminating device that is operated by turning the light to a vertical position.

In contrast to these prior art references and the known prior art, the present invention provides an illuminating device that is operatively connected to a motion detector wherein the motion detector is attached to a movable object.

SUMMARY OF THE INVENTION

The present invention provides an illuminating device that is operatively connected to a motion detector wherein the motion detector is attached to a movable object. As the movable object moves, the motion detector senses the movement and automatically energizes the illuminating device to light the environment.

It is an object of the present invention to provide a new and improved illuminating device.

It is an object of the present invention to provide a new and improved illuminating device that is easy to use.

It is an object of the present invention to provide a new and improved illuminating device that will automatically turn on.

It is an object of the present invention to provide a new and improved illuminating device that offers hands free operation.

It is an object of the present invention to provide a new and improved illuminating device that is convenient to use.

These and other objects and advantages of the present invention will be fully apparent from the following description, when taken in connection with the annexed drawings.

DESCRIPTION OF THE PREFERRED EMBODIMENT

Figure 1:
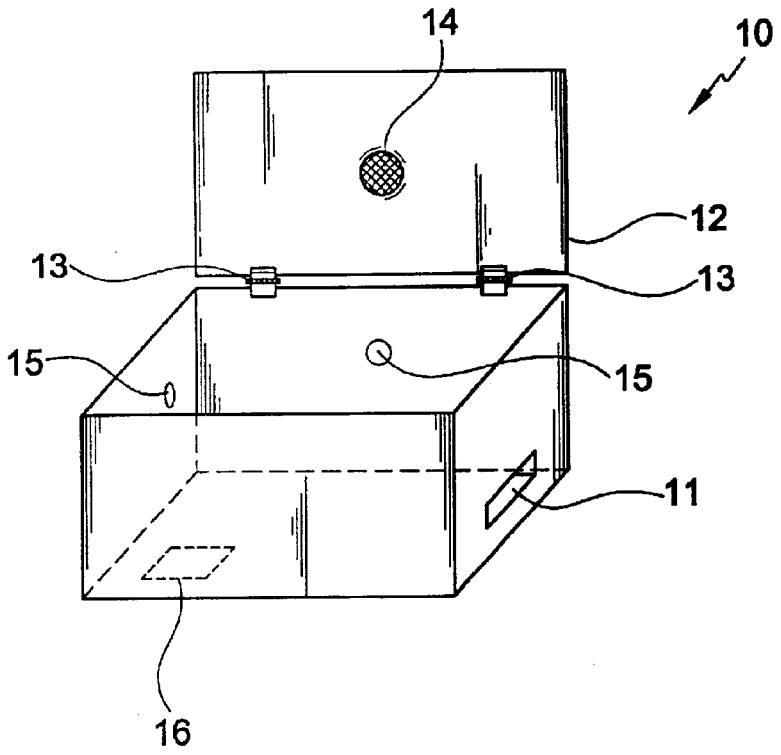
FIG. 1 is a front view of the present invention.

Referring to the drawings in greater detail, FIG. 1 shows the present invention 10 having a container 11, movable object such as a lid 12, at least one hinge 13, motion detector 14, at least one illuminating device 15, power source 16, and control switch 20. It should be noted that the present invention, as shown in FIG. 1, is merely for illustration purposes only and should not be considered the only shape, size, or form, of the present invention 10. For example, container 11 may be substantially rounded, or the like. Additionally, container 11 may be embodied as any means well known within the art to store property such as, but not limited to, a cabinet, closet, garage, house, hangar, or cooler.

Lid 12 is connected to container 11 by at least one hinge 13, which allows the user to open the container 11 in a conventional fashion. In other embodiments, movable object 12 may not be hingedly attached to container 11. Instead, movable object 12 may be attached to container 11 by any means known within the art such as, but not limited to, rollers which allow the movable object 12 to slide in a fashion similar to a closet door, garage door, or the like. It should be appreciated that movable object 12 is movable with respect to a relatively fixed object, such as container 11.

Movable object 12 is attached to a motion detector 14 by any means well known within the art. Motion detector 14 may be permanently attached to movable object 12 when the present invention 10 is manufactured or, in other embodiments, may be releasably attached to movable object 12 by means well known within the art such as, but not limited to, VELCRO hook and loop fasteners, snap connection, or the like. In other embodiments, the motion detector may not be attached to movable object 12, but to other areas inside container 11. While the present invention is described as having a motion detector 14, one of ordinary skill would realize that any number of motion detectors may be used.

Motion detector 14 is a conventional motion detector, and is operatively coupled to at least one light 15, power source 16 and switch 20. It should be appreciated that since motion detector 14 is attached to movable object 12, motion detector 14 can easily detect when movable object 12 is moved. Power source 16 may be a conventional DC power supply or, in other embodiments, an AC source. Power source 16 supplies the necessary electricity to operate the present invention 10.

The light 15 is attached to container 11 and when the light 15 is energized, the light 15 illuminates the contents of container 11. It should be understood that the light 15 may be placed anywhere within container 11 and may be placed on the movable object 12.

Figure 2:
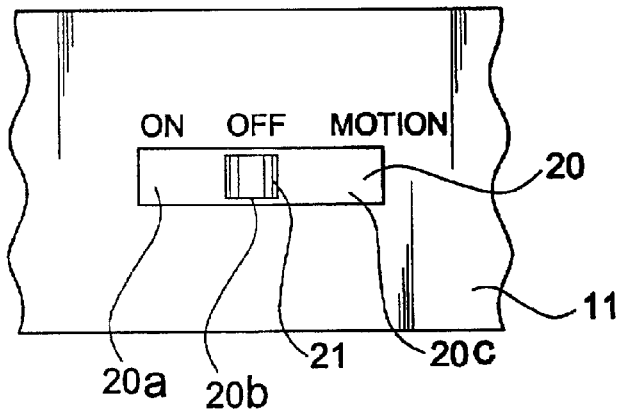
FIG. 2 is a partial side view of the present invention.

FIG. 2 is an expanded side view of the present invention 10 featuring switch 20 on a container 11. While switch 20 is described as being on container 11, one of ordinary skill would realize that switch 20 is operatively coupled to both motion detector 14 and power source 16 therefore, in other embodiments, the switch may not be physically located on container 11. In other embodiments, container 11 may be a closet wherein switch 20 would be located where a conventional switch is placed on a wall.

Switch 20 has at least one setting and, while the present invention 10 describes that switch 20 has three settings, i.e. on 20*a*, off 20*b*, and motion 20*c*, one of ordinary skill would realize that any number of settings may be used. When switch 20 is in the off position 20*b*, no current will flow to motion detector 14. When switch 20 is in the on position 20*a*, current will flow from the power supply 16 through switch 20 and to the light 15. In order to operate the present invention 10, the user sets switch 20 to the motion setting 20*c*.

After setting the switch 20 to the motion setting 20*c*, motion detector 14 will be energized since current from power source 16 will flow through switch 20 to motion detector 14. As the user moves movable object 12, as described above, the motion detector 14 automatically senses this movement thereby allowing current to flow from the power source 16 through switch 20 through motion detector 14 and to the light 15. It should be appreciated that if the present invention 10 has a plurality of lights, each light will be connected in parallel to motion detector 14. This parallel connection to motion detector 14 allows for the present invention 10 to be illuminated even in the event that one of the lights 15 is inoperable.

Figure 3:
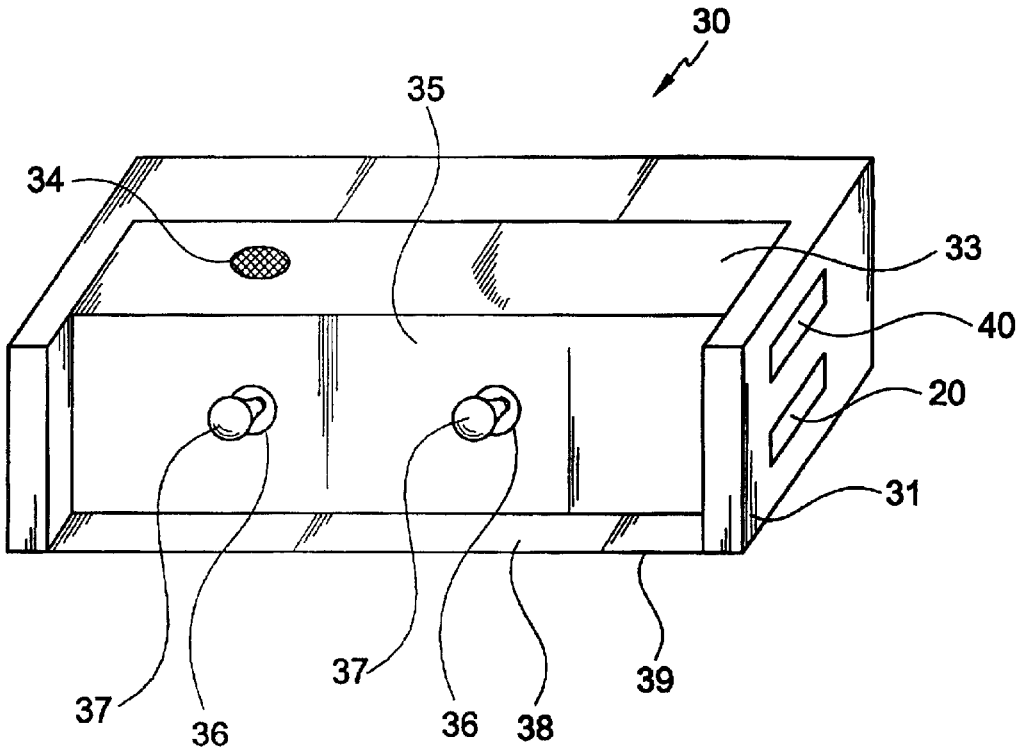
FIG. 3 is an alternative embodiment of the present invention.

FIG. 3 describes an alternative embodiment of the present invention 30 wherein the present invention 30 attaches to a container such as, but not limited to, a cooler, storage area, closet, garage, or the like. The present invention 30 features a housing 31, locking switch 40, assembly 33, control switch 20, at least one motion detector 34, reflective dome 35, at least one holder 36, at least one light bulb 37, lens 38, and attachment means 39. While the present invention 30 is shown as being substantially rectangular in shape, one of ordinary skill would readily realize that the present invention 30 may take any shape, or form, known within the art and may be various colors, shapes and sizes. Additionally, one of ordinary skill would appreciate that housing 31 and assembly 33 are two pieces wherein assembly 33 rotates within housing 31.

While FIG. 3 shows that the locking switch 40 and control switch 20 are on the same side of the present invention 30, one of ordinary skill would realize that locking switch 40 and control switch 20 may be on different sides or planes on the present invention 30.

Housing 31 is made from a material that is known to be lightweight and strong such as, but not limited to, plastic, or the like. Preferably, housing 31 is waterproof and watertight. Housing 31 features control switch 20 and locking switch 40 and attached to housing 31 is assembly 33. Control switch 20 operates as described above and the mechanism of locking switch 40 is described below. Housing 31 also features an attachment means 39 that allows the present invention 30 to attach to containers, or the like, as described above. The attachment means 39 may be any attachment means known within the art such as, but not limited to, a snap connection, VELCRO hook and loop fasteners, or the present invention 30 may be fastened to a container, or the like, by screws.

Assembly 33 is rotatably attached to housing 31 by means well known in the art. Preferably, during the manufacture of assembly 33, one spindle (not shown) is on either side of assembly 33 and inserts into a hole (not shown) within housing 31. In other embodiments, at least one of the spindles on either side of assembly 33 may be spring-loaded.

As shown in FIG. 3, assembly 33 is in the Y-position, however assembly 33 may rotate into the X-position. Assembly 33 made be made from the same material as housing 31 however, in other embodiments, housing 31 and assembly 33 may be made from different materials. Assembly 33 features at feast one motion detector 34, reflective dome 35, at least one holder 36, at least one light bulb 37, and lens 38. It should be appreciated that the motion detector 34, holder 36, light bulb 37 and control switch 20 are all operatively connected to a power source (not shown) similar to power source 16 in FIG. 1. Reflective dome 35, which is attached to assembly 33, is shiny in order to allow light to reflect from the light bulb 37. The light bulb 37 is inserted into the holder 36 in a convention fashion. Lens 38 is releasably attached to assembly 33. Lens 38 could be manufactured from clear plastic, or the like, or, in other embodiments, lens 38 could be colored, such as red, so that the present invention 30 could be used during darkness.

Figure 4:
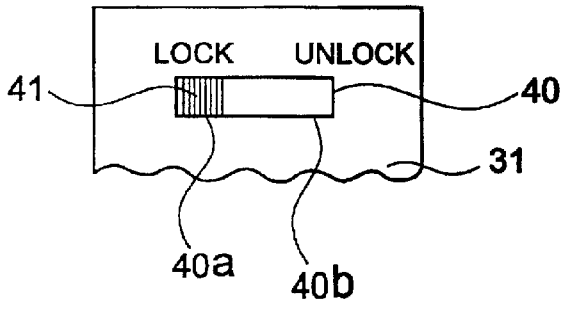
FIG. 4 is a partial side view of an alternative embodiment of the present invention.

FIG. 4 is a partial side view of the present invention 30 featuring locking switch 40 on housing 31. Locking switch 40 is operatively coupled to assembly 33 and while the operating button 41 of locking switch 40 is in the lock position 40*a*, the assembly 33 cannot be rotated. However, when the user moves button 41 to the unlock position 40*b*, the user is free to rotate the assembly to either the X-position or the Y-position.

Figure 5:
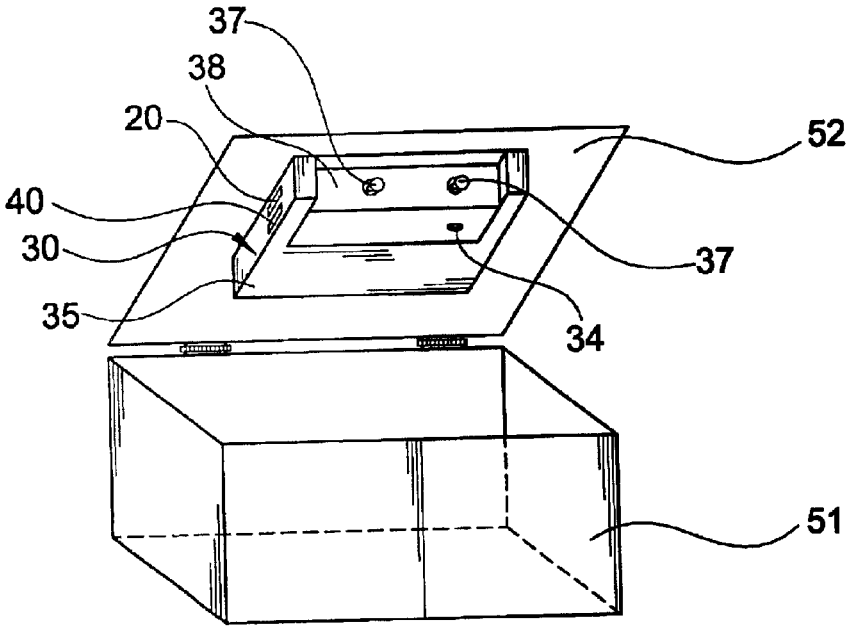
FIG. 5 is a view of a alternative embodiment of the present invention attached to a container.

FIG. 5 shows the present invention 30 connected to the lid 52 of container 61. The present invention 30 attaches to lid 52 by the attachment means 39. It should be appreciated that the present invention 30 is in the Y-position, as described above. In order to use the present invention 30, the user must set the control switch 20 to the motion position 20*c*. As the user lifts the lid 52 of container 51, the motion detector 34 will sense the movement and the light 37 will turn on. Therefore, the contents of the container will be illuminated. One of ordinary skill would realize that when lid 52 is closed, the motion detector 34 will no longer sense movement, therefore the light 37 will shut off after a predetermined amount of time. Of course, in other embodiments, the light 37 will automatically turn off once no movement is detected by the motion detector 34.

Figure 6:
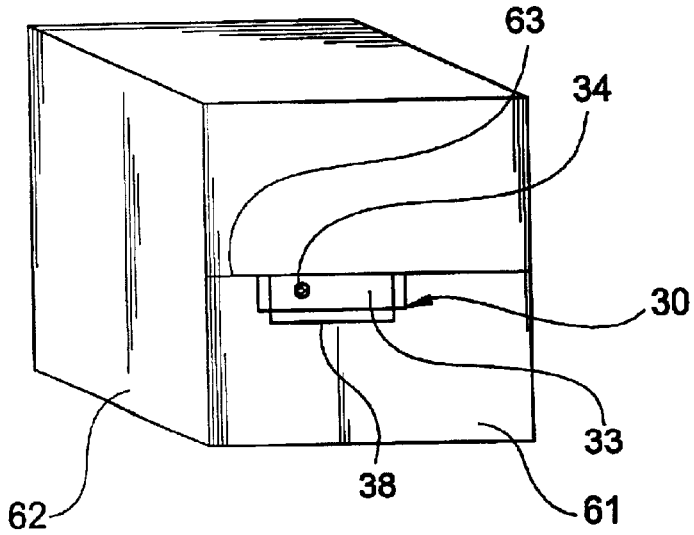
FIG. 6 is a view of an alternative embodiment of the present invention attached to a cabinet.

FIG. 6 shows the present invention 30 connected to the bottom of shelf 63 of cabinet 61 having a door 62. It should be appreciated that the present invention 30 is in the X-position wherein the light 37 is pointing towards the contents of cabinet 61. As the user opens the door 62 of cabinet 61, the motion detector 34 senses the movement and the 37 turns on, wherein the contents of the cabinet 61 are automatically illuminated. One of ordinary skill would realize that when lid 62 is closed, the motion detector 34 will no longer movement, therefore the light 37 will shut off after a predetermined amount of time. Of course, in other embodiments, the light 37 will automatically turn off once no movement is detected by the motion detector 34.

Although the smart light and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim my invention is:

1. A system comprising:

a housing having a top, bottom and two sides, an assembly is attached to said housing, an attachment means secured to said housing for securing said top, wherein said assembly further comprises:

at least one motion detector, at least one light, and wherein said at least one motion detector and at least one light are operatively connected to each other, and wherein a lens is attached to the assembly, and wherein the lens is clear, and further comprising a control switch wherein the control switch has at least two settings, and wherein a locking switch is operatively coupled to the assembly.

2. The system as set forth in claim 1 said control switch is operatively coupled to the at least one motion detector, and a power source is operatively coupled to the control switch.

3. The system as set forth in claim 1 wherein the assembly is rotatably attached to the housing.

4. The system as set forth in claim 1 wherein the attachment means comprises hook and loop fasteners.

* * * * *